United States Patent [19]

Treadwell et al.

[11] Patent Number: 4,545,310

[45] Date of Patent: Oct. 8, 1985

[54] METHOD AND APPARATUS FOR ACCURATELY CONTROLLING THE SEAM MARGINS PRODUCED BY A SEMI-AUTOMATIC SEWING MACHINE

[75] Inventors: Stephen S. Treadwell, Richardson; Donald D. Isett, Dallas, both of Tex.

[73] Assignee: Microdynamics, Inc., Dallas, Tex.

[21] Appl. No.: 566,655

[22] Filed: Dec. 29, 1983

[51] Int. Cl.[4] ..... D05B 19/00

[52] U.S. Cl. ..... 112/121.11; 112/262.1; 112/315; 112/272

[58] Field of Search ..... 112/121.11, 121.12, 112/275, 277, 315, 316, 317, 314, 2, 272, 262.1

[56] References Cited

U.S. PATENT DOCUMENTS

| | | | |
|---|---|---|---|
| 4,154,179 | 5/1979 | Arnold | 112/317 |
| 4,381,719 | 5/1983 | Goldbeck | 112/121.11 |
| 4,404,919 | 9/1983 | Martell et al. | 112/315 X |

*Primary Examiner*—Peter Nerbun

*Attorney, Agent, or Firm*—Jerry W. Mills; Gregory M. Howison

[57] ABSTRACT

An adaptive semi-automatic sewing system (10) comprises a sewing machine (12), a drive unit (42) including a variable speed direct drive motor and encoder for counting stitches sewn and for sensing the rotation of the motor, at least one material edge sensor (40) mounted ahead of the needle (22) of the sewing machine, and a microprocessor controller (51) coupled to the sewing machine controls. Accurate control of seam lengths and end points is achieved by initiating countdown of a variable number of final stitches responsive to detection of the material edge by the sensors (40). The amount of stitch completion at the time of detection of the material edge is monitored and a stitch length variance mechanism (17) is actuated at a selected angle of motor rotation taking into account the time delay of the stitch length variance mechanism and the feed characteristics of sewing machine (12) to precisely control the length of the last stitch sewn to improve the accuracy of the seam end point.

13 Claims, 6 Drawing Figures

FIG. 1
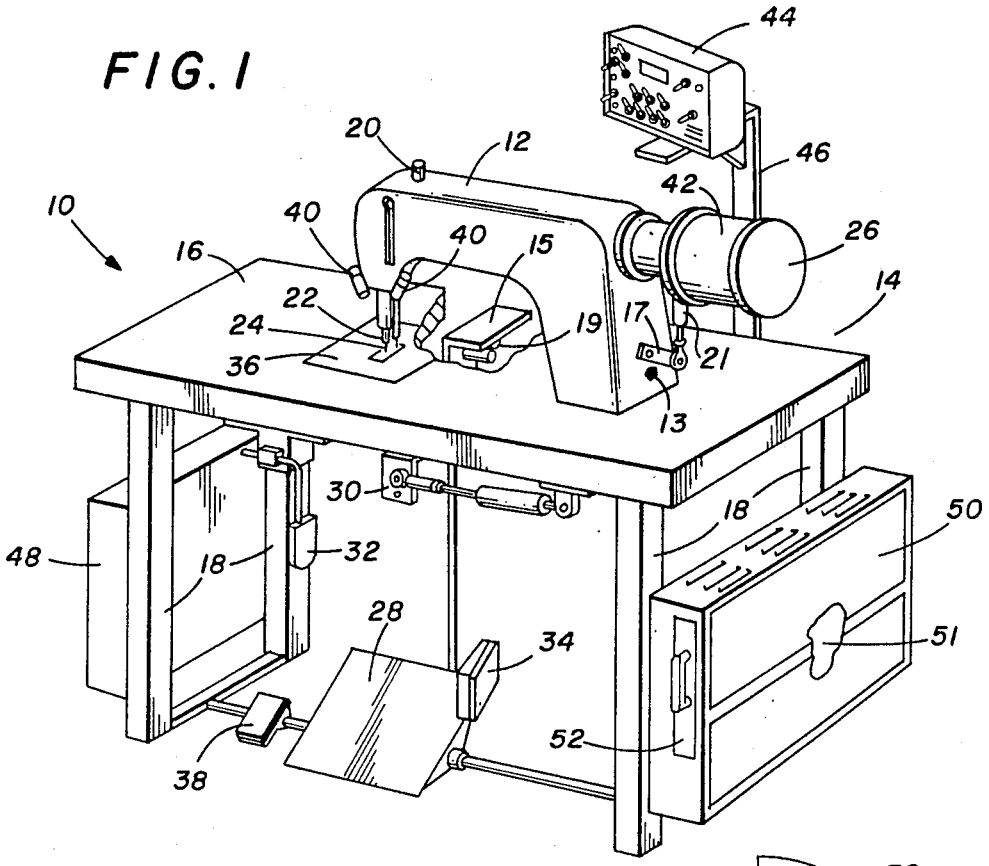
FIG. 2
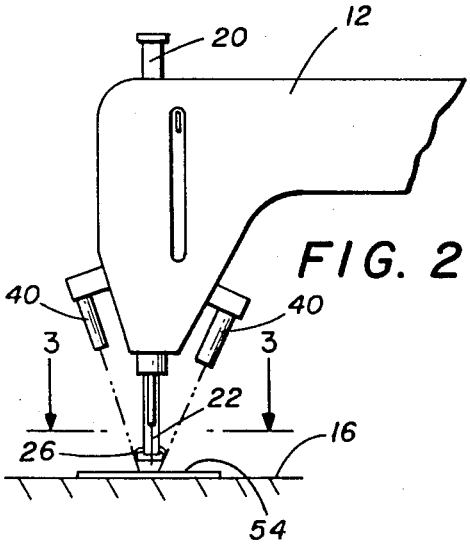
FIG. 3
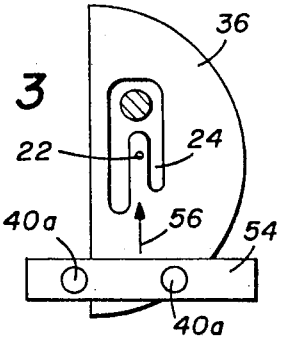
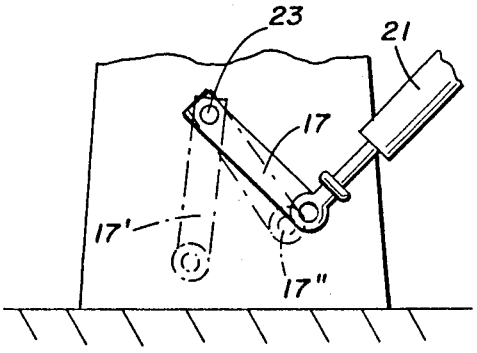
FIG. 4

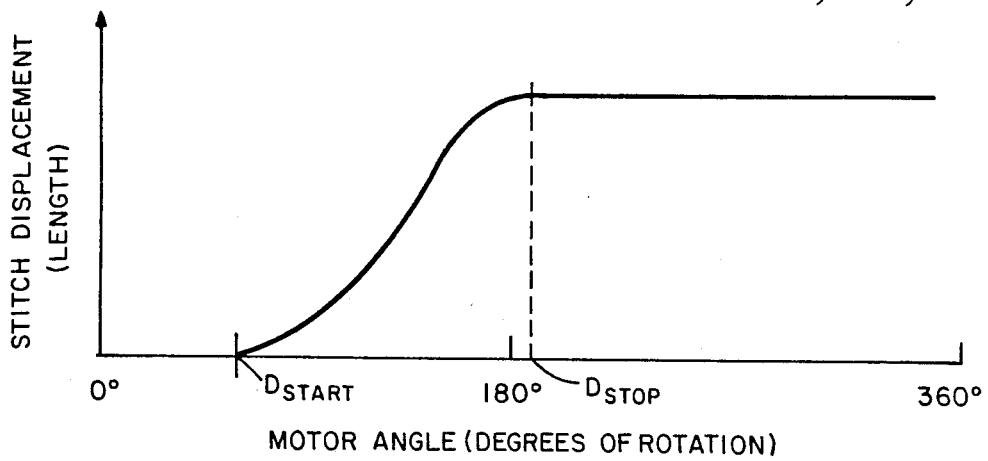
FIG. 5
FIG. 6
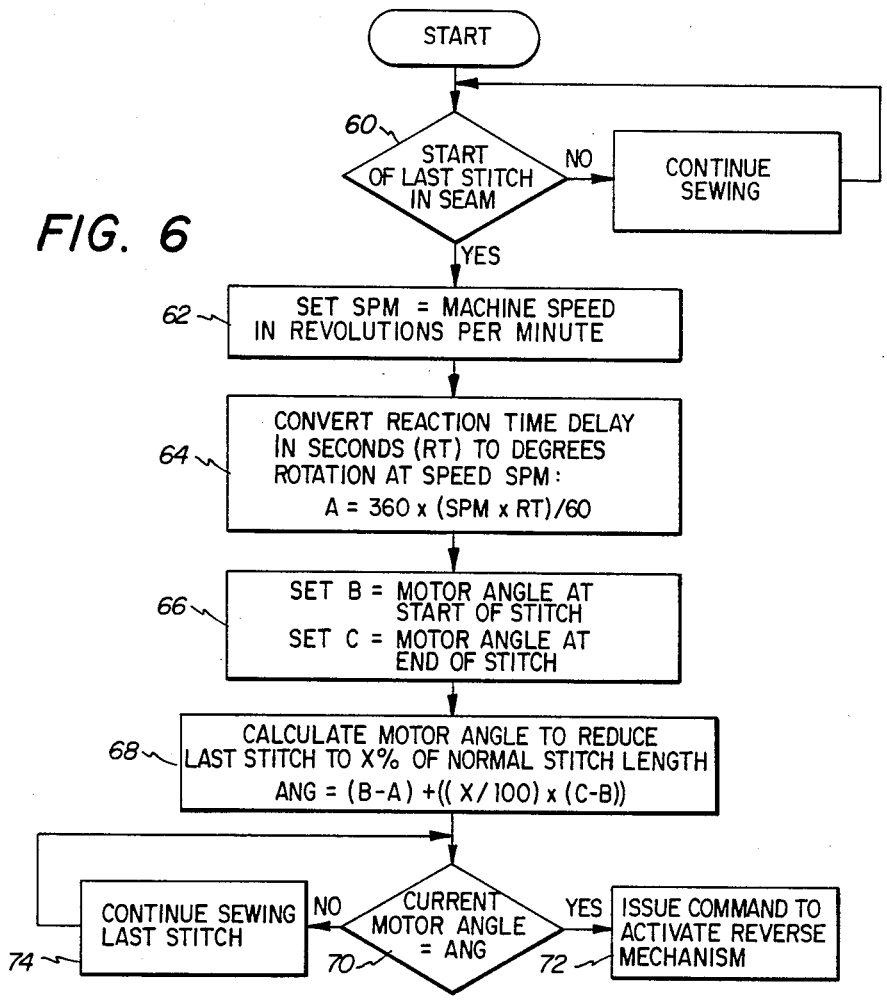

METHOD AND APPARATUS FOR ACCURATELY CONTROLLING THE SEAM MARGINS PRODUCED BY A SEMI-AUTOMATIC SEWING MACHINE

TECHNICAL FIELD

The present invention relates generally to a control system to adapt a sewing machine for semi-automatic operation. More particularly, this invention is directed to an adaptive sewing machine control system incorporating a microprocessor controller in combination with a stitch counter, an edge sensor and stitch length control apparatus to achieve more precise seam lengths and end points.

BACKGROUND OF THE INVENTION

In the sewn goods industry, where various sections of material are sewn together to fabricate products, precise seam lengths and end points are often necessary for proper appearance and function of the finished products. For example, the top stitch seam of a shirt collar must closely follow the contour of the collar and terminate at a precise point which matches the opposite collar. Accurate seam lengths must similarly be maintained in the construction of shoes when sewing together vamps and quarter pieces to achieve strength as well as pleasing appearance. Achieving consistently accurate seam lengths and end points at high rates of production has, however, been a long standing problem in the industry.

Microprocessor controllers have been developed which convert manually operated sewing machines into semi-automatic sewing systems. U.S. Pat. Nos. 4,108,090; 4,104,976; 4,100,865; and 4,092,937, assigned to the Singer Company are representative of such devices. Each of those patents discloses a programmable sewing machine with three operational modes: manual, teach and auto. Control parameters are programmed into the system for subsequent control of the sewing machine in the auto mode. Those microprocessors control all sewing machine functions such as sewing speed, presser foot position, thread trimmer, reverse sew mechanism and the number of stitches sewn in each individual seam. Accurate control of seam lengths is one of the important aspects of those systems.

U.S. Pat. No. 4,404,919 issued Sept. 20, 1983, entitled "Control System for Providing Stitch Length Control of a Sewing Machine", assigned to assignee describes a microprocessor controlled sewing system which improves upon the seam length accuracy of those systems. The system disclosed in U.S. Pat. No. 4,404,919 controls seam length accuracy using a combination of stitch counting, edge detection and stitch length control techniques. Control of seam lengths and end points is achieved in the system by initiating countdown of a variable number of final whole and partial stitches responsive to detection of the end of the material being sewn by sensors located ahead of the needle. In dependence upon the amount of the stitch which has been sewn upon edge detection, the microprocessor issues a signal to position the reverse sew mechanism of the sewing machine while the last stitch is being formed to reduce the length of the last stitch to a desired percentage of the normal stitch length and thus improve the accuracy of the seam end point.

Though ideally the time delay between the microprocessor issuing the signal to activate the reverse sew mechanism and the actual movement of the mechanism to reduce the length of the last stitch is zero, in practice, that time delay is typically in the range of 10 to 40 milliseconds. Were the sewing machine operated so that stitches are formed continuously during a complete revolution of the sewing machine motor, that delay could be easily compensated for and the desired results achieved be issuing the signal to activate the reverse sew mechanism, for example, 10 to 40 milliseconds early. However, the formation of stitches in a typical sewing machine occurs in an intermittent manner, each stitch being formed during approximately 120 degrees of revolution for each complete revolution of the motor and no stitch formation occurring in the remaining 240 degrees of revolution. The combination of retraction time delay and intermittent feed often causes the length of the last stitch to vary from the desired length.

A need has arisen, therefore, for an improved adaptive sewing machine control system which includes a stitch length control technique which compensates for the activation time delay of the reverse mechanism and intermittent feed characteristics of the sewing machine to accurately reduce the length of the last stitch.

SUMMARY OF INVENTION

The present invention comprises an adaptive sewing machine control system which substantially improves seam length accuracy by dynamically reducing and accurately controlling the length of the last stitch in the seam.

In accordance with the invention, there is provided a system including a microprocessor controller which can be programmed with or taught a sequence of sewing operations by the operator in one mode for automatically controlling the machine during subsequent sewing of similar pieces of the same or different sizes in another mode. The semi-automatic system uses a combination of stitch counting and material edge detection techniques together with techniques for varying the length of the last stitch sewn to achieve more accurate seam length and end point control.

More specifically, this invention comprises a microprocessor-based control system for an industrial sewing machine. The system has manual, teach and auto modes of operation. In the preferred embodiment, one or more sensors are mounted in front of the presser foot for monitoring edge conditions of the material at the end of each seam. In the teach mode, operating parameters are programmed into the controller by the operator. For each seam, the number of whole and partial stitches x sewn after the desired status change in the sensors are recorded along with sewing machine and auxiliary control inputs. In the auto mode, the number of stitches sewn in each seam is monitored until the characteristic sensor pattern indicating edge detection is seen, at which time x additional stitches are sewn to complete the seam. The amount of stitch completion at the time of detection of the material edge is monitored and the reverse sew mechanism of the sewing machine is actuated at a selected point taking into account the activation time delay of the reverse sew mechanism and the feed characteristics of the sewing machine to control the length of the last seam stitch to the desired length.

BRIEF DESCRIPTION OF DRAWINGS

A more complete understanding of the invention can be had by reference to the following detailed description taken in conjunction with the accompanying Drawing, in which:

FIG. 1 is a perspective view of a programmable sewing system incorporating the invention;

FIG. 2 is a front view illustrating placement of the edge sensor relative to the sewing needle;

FIG. 3 is a sectional view taken along lines 3—3 of FIG. 2 in the direction of the arrows;

FIG. 4 is an end view of the sewing system illustrating the automatic control apparatus of the sewing machine reverse mechanism;

FIG. 5 is a graph illustrating the degrees of rotation of a sewing machine motor plotted against the length of a resulting stitch; and FIG. 6 is a flowchart of the technique of the present invention to dynamically reduce the length of the last stitch to a desired percentage of the normal stitch length.

DETAILED DESCRIPTION OF THE INVENTION

Referring now to the Drawing, wherein like reference numerals designate like or corresponding parts throughout, FIG. 1 illustrates a semi-automatic sewing system 10 incorporating the invention. System 10 is a microprocessor-based system adapted to extend the capabilities of a sewing machine to enable the operator to perform sewing procedures on a manual or semi-automatic basis.

System 10 includes a conventional sewing machine 12 mounted on a work stand 14 consisting of a table top 16 supported by four legs 18. Sewing machine 12, which is of conventional construction, includes a spool 20 containing a supply of thread for stitching by a reciprocable needle 22 to form a seam in one or more pieces of material. Surrounding needle 22 is a vertically movable presser foot 24 for cooperation with movable feed dogs (not shown) positioned within table top 16 for feeding material past the needle.

A number of standard controls are associated with sewing machine 12 for use by the operator in controlling its functions. A handwheel 26 is attached to the drive shaft (not shown) of machine 12 for manually positioning needle 22 in the desired vertical position. Sewing speed is controlled by a speed sensor 15 which is actuated by a foot treadle 28, which functions as an accelerator. Vertical positioning of presser foot 24 can be controlled by heel pressure on foot treadle 28 which closes a switch 19 in speed sensor 15, which in turn causes the presser foot lift actuator 30 to operate. A leg switch 32 is provided for controlling the sewing direction of machine 12 by causing operation of a reverse sew mechanism 17. The reverse sew mechanism 17 is positioned by a stepper motor 21 which can position the reverse sew mechanism 17 in various positions to vary the length of the stitch formed by the sewing machine 12. The reverse sew mechanism 17 and stepper motor 21 are referred to in combination as the stitch length variance mechanism. A toe switch 34 located adjacent to foot treadle 28 controls a conventional thread trimmer (not shown) disposed underneath the throat plate 36 of machine 12. Foot switch 38 on the other side of foot treadle 28 comprises a one-stitch switch for directing machine 12 to sew a single stitch.

Sewing machine 12 and its associated manual controls are of substantially conventional construction, and may be obtained from several commercial sources, e.g., Singer, Union Special, Pfaff, Consew, Juki, Columbia, Brother or Durkopp Companies.

In addition to the basic sewing machine 12 and its manual controls, system 10 includes several components for adapting the sewing machine for semi-automatic operation. One or more sensors 40 are mounted in laterally spaced-apart relationship in front of needle 22 and presser foot 24. A drive unit 42 comprising a variable speed direct drive motor, sensors for stitch counting and an electromagnetic brake for positioning of needle 22, is attached to the drive shaft of sewing machine 12. A main control panel 44 supported on a bracket 46 is provided above one corner of work stand 14. A pneumatic control chassis 48 containing an air regulator, filter and lubricator for the sewing machine control sensors, pneumatic actuators and other elements of system 10 is provided on one side of work stand 14. All of these components are of known construction and are similar to those shown in U.S. Pat. Nos. 4,108,090; 4,104,976; 4,100,865 and 4,092,937, the disclosures of which are incorporated herein by reference.

A controller chassis 50 is located on the opposite side of work stand 14 for housing the electronic components of system 10. Chassis 50 includes a microprocessor controller 51, appropriate circuitry for receiving signals from sensors and carrying control signals to actuators, and a power module for providing electrical power at the proper voltage levels to the various elements of system 10. The microprocessor controller 51 may comprise a Zilog Model Z-80 microprocessor or any suitable unit having a read only memory (ROM) and random access memory (RAM) of adequate storage capacities. An auxiliary control panel 52 is mounted for sliding movement in one end of chassis 50.

Referring now to FIGS. 2 and 3, further details of edge sensors 40 and their cooperation with needle 22 can be seen. Sensors 40 may be mounted directly on the housing of sewing machine 12, or supported by other suitable means. Each sensor 40 comprises a lamp/-photosensor which projects a spot of light **40*a* onto a reflective tape strip 54 on throat plate 36. The status of each sensor 40** is either "on" or "off" depending upon whether or not the light beam thereof is interrupted, such as by passage of the trailing edge or discontinuity of the particular piece of material.

Sensors 40 are positioned in mutually spaced relationship ahead of needle 22 and sewing machine 12. The condition of at least one sensor 40 changes as the trailing material edge passes thereunder to indicate approach of the seam end point. Sensors such as the Model 10-0672-02 available from Clinton Industries of Carlstadt, N.J., have been found satisfactory as sensors 40, however, infrared sensors and emitters, or pneumatic ports in combination with back pressure sensors could also be utilized, if desired.

Circuitry is provided in chassis 50 which detects the output of sensors 40 to generate electrical signals representative of the material edge. Controller 51 is responsive to such edge detection for allowing a selected number of stitches to be sewn after the edge detection. Controller 51 also determines the amount of the currently sewn stitch which has been completed at edge detection in response to the sewing machine motor rotation. Depending upon the amount of the stitch sewn at edge detection and taking into account the activation time delay of the stitch length variance mechanism and the interval of motor rotation during which a seam is formed, controller 51 controls the stitch length variance mechanism of the machine to vary the length of the last stitch sewn to a desired percentage of the normal stitch length.

The present system may first be programmed in a teach mode and thereafter operated in an auto mode. The system may be taught in the teach mode to sew x stitches after the material edge is detected where x can be a combination of whole and partial stitches. Thereafter, when the system is operated in the auto mode, the edge of the material will be automatically detected by the sensor and the machine will then automatically sew x stitches before terminating the seam. In this manner, automatic operation of the system is provided to increase the speed and accuracy of the system without human intervention. The present system operates in essentially the same manner as the system described in U.S. Pat. No. 4,404,919, the disclosure of which is incorporated herein by reference, with additional improvement and accuracy being provided by the present invention as will be subsequently described.

In operation of the system thus described, as a seam is sewn by the machine, the number of stitches from the starting point are counted by the encoder within drive unit 42. The reflective tape 54 will be covered by the material and the beams of the sensors 40 are blocked by the material. When the edge of the material moves past the reflective tape 54, the sensor beams are reflected from the reflective tape 54 and sensed. This provides the system with an indication of the location of the edge of the material so that the seam length can be stopped at a given distance from the material edge. The system is originally taught by the operator to sew a given number of whole and partial stitches x in a seam after the edge of the material is detected. When the operation is repeated in the automatic sewing mode, the system will sew until the edge is detected, and will then sew x stitches before terminating the seam. Depending upon the percentage of the stitch which has been sewn at the time of detection of the material edge, the reverse sew mechanism is positioned to vary the length of the last stitch sewn to provide increased accuracy to the seam termination.

Referring to FIG. 4, an enlarged view of the reverse sew assembly is illustrated. A stepper motor 21 is actuated to pivot reverse sew mechanism 17 about a pivot point 23. Mechanism 17 is illustrated in the solid line position in its normal operating position in the forward sew mode. When mechanism 17 is fully activated by stepper motor 21 to position 17', the sewing machine will form one normal length stitch in the reverse direction. Positioning mechanism 17 at position 17'' will result in a reduced length stitch being sewn in the forward direction. Therefore, stepper motor 21 can be used to vary the stitch length produced. Mechanism 17 and stepper motor 21 form a stitch length variance mechanism which is controlled by the microprocessor to control the length of the last stitch in each seam.

It will be understood that other techniques may be used to vary the length of the stitch. For example, the material feeding mechanism, known as feed dogs, may be retracted by an air cylinder while the last stitch is being formed. The air cylinder may be operated by a solenoid control actuated by the microprocessor, in order to accurately vary the length of the last stitch formed.

FIG. 5 illustrates the feeding characteristics of a typical sewing machine such as shown in FIG. 1 wherein stitch formation occurred in an intermittent manner over approximately 120 degrees of the motor rotation. As shown in FIG. 5, the stitch is not begun until the motor has rotated approximately 60 degrees at DSTART. The stitch is then formed until it is completed at DSTOP after the sewing machine motor has completed approximately 180 degrees rotation. The last 180 degree rotation of the sewing machine motor enables the machine to ready for the formation of the next stitch. The interval of the motor rotation over which stitch formation occurs is stored by controller 51 to enable the percentage of the stitch completed at edge detection to be computed for each seam.

If the time delay was zero between controller 51 issuing a signal to activate reverse sew mechanism 17 and the actual actuation of reverse sew mechanism 17, the length of the last stitch could be thus accurately reduced to the desired length regardless of the point in the formation of the last stitch at which the microprocessor signalled activation of reverse sew mechanism 17. In practice, however, an activation time delay, typically in the 10 to 40 millisecond range, will exist between the issuance of the signal and the actual actuation of reverse sew mechanism 17. That time delay coupled with the intermittent feed characteristics of the sewing machine, described above with reference to FIG. 5, causes the length of the last stitch to vary from the desired length.

For example, if the speed of the sewing machine is 300 revolutions per minute at the time the last stitch is initiated, 200 milliseconds are required for one revolution of the sewing machine motor. Because a stitch is actually formed during only one-third of a motor revolution, stitch formation occurs over an interval of approximately 67 milliseconds. Assume that the activation delay time associated with the reverse mechanism is 30 milliseconds, or approximately 50% of stitch formation time. Thus, if controller 51 issues a command to actuate the reverse mechanism when 10% of the last stitch has been formed, the system will actually produce a stitch approximately 60% of a normal stitch length because of the activation time delay. Similarly, if the actuation signal is issued at the start of the last stitch, the stitch will be 50% of a normal stitch length and if issued after 50% of the last stitch has been formed, the last stitch will be 100% of a normal stitch length. Thus in this example, the last stitch will always be 50 to 100% of a normal stitch length, depending upon when the signal is issued.

The system of the present invention improves upon the operation of the system of U.S. Pat. No. 4,404,919 by issuing the signal to actuate the reverse mechanism at a selected point in the motor revolution which compensates for the activation time delay and intermittent feed characteristics and thereby produces more accurate seam margins. FIG. 6 is a flow chart illustrating the technique of the present invention for determining the motor angle at which a signal to actuate of the reverse mechanism should be issued to compensate for those factors. The steps are implemented by suitable programming of controller 51. The program is suitable for adaptation to the Zilog Z-80 microprocessor and may be written into Z-80 assembly language in a manner known to the art.

In accordance with the present invention, once the start of the last stitch in the seam is sensed at 60, the machine speed in revolutions per minute is determined at 62. At 64 the number of degrees of motor rotation taken during the activation time delay is then computed by the formula: 360* (SPM*RT)/60, where SPM is the speed of the motor while the last stitch is formed in revolutions per minute and RT is the activation time delay in seconds. Before the start of the sewing operation, the machine operator measures the activation time delay and enters that time as data to controller 51 by means of operator control panel 52. The operator also inputs to controller 51, data defining the motor angles at which stitch formation begins and ends. This data is stored in the memory associated with the microprocessor of controller 51. The motor angle of rotation at which the signal to actuate reverse mechanism 17 should be issued to reduce the length of the last stitch to x% of the normal stitch length is computed at 68 using the formula: (B−A) +((x/100)* (C−B)), where A is the number of degrees of motor rotation taken during the activation time delay, B is the motor angle at the start of the stitch and C is the motor angle at the end of the stitch. A determination of whether that motor angle of rotation has been reached is made at 70. If it has, a command to activate the reverse sew mechanism is issued at 72 otherwise, sewing continues at 74. If the result of the calculation of the motor angle is negative, the command to activate the reverse sew mechanism is issued in the stitch preceding the last stitch at a motor angle equal to that angle plus 360 degrees. This technique assures that the last stitch can be varied from 0 to 100% of the normal stitch length and accurate seam margins are thereby produced.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. In a sewing machine having a material feed and a reciprocable needle for stitching seams in material, a drive motor and a stitch length variance mechanism having a finite activation time delay, seam length control apparatus comprising:

means for detecting a material discontinuity in advance of the end of a seam;

means for controlling the reciprocable needle to sew a predetermined number of stitches after said detecting means detects said material discontinuity; and means responsive to said detecting means for operating the stitch length variance mechanism at an angle of drive motor rotation which compensates for the activation time delay associated with the stitch length variance mechanism and the material feed characteristics to vary the amount of completion of the last stitch of said predetermined number of stitches and thus precisely control the length of the seam.

2. In a sewing machine having a material feed and a reciprocable needle for stitching seams in material, a drive motor and a stitch length variance mechanism having a finite activation time delay, seam length control apparatus comprising:

means for detecting a material discontinuity in advance of the end of a seam;

means for controlling the reciprocable needle to sew a predetermined number of stitches after said detecting means detects said material discontinuity; and means responsive to said detecting means for operating the stitch length variance mechanism to reduce the length of the last stitch to a desired percentage of the normal stitch length at an angle of drive motor rotation computed according to the formula:

$$B-(360*(SPM*RT)/60))+((X/100)*(C-B)),$$

where B is the drive motor angle at which stitch formation begins, SPM is the speed of the drive motor while the last stitch is formed in revolutions per minute, RT is the activation time delay in seconds, X is the desired Percentage of the normal stitch length, and C is the drive motor angle at which stitch formation ends.

3. The seam length control apparatus of claim 1 wherein:

said means for operating the stitch length variance mechanism is dependent upon the amount of completion of the stitch being sewn at the time of detection of said material discontinuity.

4. The seam length control apparatus of claim 1 wherein said stitch length variance mechanism comprises:

means for operating the reverse mechanism of the sewing machine to control the length of the last stitch.

5. The seam length control apparatus of claim 1 wherein said stitch length variance mechanism comprises:

means for controlling the operation of the material feed of the sewing machine.

6. The seam length control apparatus of claim 2 and further comprising means for storing B, C, and RT.

7. The seam length control apparatus of claim 2 and further comprising digital processing means for operating upon said formula and for generating a signal for operation of said stitch length variance mechanism at the desired time.

8. A method of operating a sewing maching having a reciprocable needle for stitching seams in material, a drive motor, and a stitch length variance mechanism having an activation time delay comprising:

detecting a material discontinuity in advance of the end of a seam being sewn by the sewing machine;

controlling the reciprocable needle to sew a predetermined number of stitches after detecting said material discontinuity; and operating the stitch length variance mechanism at an angle of drive motor rotation which compensates for the time delay associated with operating the stitch length variance mechanism to precisely control the amount of completion of the last stitch of said predetermined number of stitches in response to the detection of said material discontinuity to thus precisely control the length of the seam.

9. The method of claim 8 and further comprising operating the stitch length variance mechanism at an angle of drive motor rotation which compensates for the material feed characteristics of the sewing machine.

10. A method of operating a sewing machine having a reciprocable needle for stitching seams in material, a drive motor, and a stitch length variance mechanism having an activation time delay comprising:

detecting a material discontinuity in advance of the end of a seam being sewn by the sewing machine;

controlling the reciprocable needle to sew a predetermined number of stitches after detecting said material discontinuity; and operating the stitch length variance mechanism at an angle of drive motor rotation computed according to the formula and which compensates for the time delay associated with operating the stitch length variance mechanism and the material feed characteristics of the sewing machine:

$$(B-(360*(SPM*RT)/60)) \pm((X/100)*(C-B)),$$

where B is the motor angle at which stitch formation begins, SPM is the speed of the motor while the last stitch is formed in revolutions per minute, RT is the activation time delay in seconds, X is the desired percentage of the normal stitch length, and C is the motor angle at which stitch formation ends.

11. The method of claim 10 and further comprising:

measuring B, C and RT; and storing B, C and RT for subsequent use in the formula of claim 10.

12. The method of claim 8 wherein the length of the last stitch is varied by operation of the reverse mechanism of the sewing machine at the selected angle of the drive motor rotation.

13. The method of claim 8 wherein the length of the last stitch is varied by control of the feed mechanism of the sewing machine at the selected angle of the drive motor rotation.

* * * * *